US005331993A

United States Patent [19]

Billbury

[11] Patent Number: 5,331,993

[45] Date of Patent: Jul. 26, 1994

[54] COVER FASTENING DEVICE

[76] Inventor: Ronald R. Billbury, 7239 Cardinal, Algonac, Mich. 48001

[21] Appl. No.: 936,251

[22] Filed: Aug. 27, 1992

[51] Int. Cl.[5] ..... E04H 15/64

[52] U.S. Cl. ..... 135/119; 160/368.1; 403/291; 296/100; 114/361; 280/770; 135/88

[58] Field of Search ..... 135/88, 119; 403/202, 403/237, 291; 24/341, 342; 160/330, 368.1, 354, 327, 399, 402; 280/762, 769, 770; 296/100; 114/361

[56] References Cited

U.S. PATENT DOCUMENTS

| | | | |
|---|---|---|---|
| 1,745,553 | 2/1930 | Mitmann | 24/341 X |
| 2,937,652 | 5/1960 | Zimmer, Jr. et al. . | |
| 2,961,725 | 11/1960 | McGee . | |
| 3,172,419 | 3/1965 | Lewis . | |
| 3,192,542 | 7/1965 | Mills, II . | |
| 3,287,841 | 11/1966 | Spragg et al. | 24/342 X |
| 3,304,657 | 2/1967 | Singleton . | |
| 3,367,349 | 2/1968 | O'Link . | |
| 3,572,353 | 3/1971 | Pinkley . | |
| 3,774,959 | 11/1973 | Brudy . | |
| 3,905,414 | 9/1975 | Guebert et al. | 24/342 X |
| 4,153,097 | 5/1979 | Pettibone | 160/330 |
| 4,237,958 | 12/1980 | Guebert et al. | 160/330 |
| 4,277,864 | 7/1981 | Orson, Sr. | 24/342 X |
| 4,292,913 | 10/1981 | Siebert et al. . | |
| 4,692,969 | 9/1987 | Johnson | 296/136 X |
| 4,993,351 | 2/1991 | Zirkelbach et al. . | |
| 5,009,050 | 4/1991 | Gruber | 160/402 X |

*Primary Examiner*—Carl D. Friedman
*Assistant Examiner*—Lan C. Mai
*Attorney, Agent, or Firm*—Brooks & Kushman

[57] ABSTRACT

A fastening device for assisting and securing a cover to a boat frame when the boat frame is generally square in cross-section. The fastening device is comprised of a base wall member and a pair of resilient arms that extend outwardly from one side of the base wall member at an angle substantially perpendicular to the base wall member. The resilient arms are adapted to extend substantially along the top and bottom sides of the boat railing toward the back side of the boat railing. The resilient arms have a gripping hook on the distal end thereof depending inwardly toward one another with each hook being adapted to curve around the radial edges of the boat rail. A snap stud is affixed or molded to the fastening device.

6 Claims, 2 Drawing Sheets

COVER FASTENING DEVICE

TECHNICAL FIELD

The present invention relates to a cover or canopy fastening device, and particularly to a detachable cover fastening device for use on common boat railings.

BACKGROUND OF THE INVENTION

The prior art discloses a variety of different fastening devices for use in affixing a boat cover or canopy across various open spaces on a boat. Many designs utilize a snap lock system comprised of a male fastening stud attached to the boat surface and a female receiving snap attached to a boat cover.

Snap studs are commonly attached permanently to a boat railing which extends around the exterior body of the boat and sometimes across the top or sides of a windshield portion. In manufacture, this process of permanently attaching snap studs measured distances between each other along the boat rails requires considerable time and expense. Furthermore, difficulties occur when the canvas material or canopy material used to cover the open spaces of the boat change in dimension due to stretching or shrinkage by continued weathering or use, or when the cover is produced with widely varying dimensioned quality standards. These changes in dimension of the boat covers make it difficult to fasten the female receiving snap onto the studs which are not adjustable along the boat rails. It then becomes necessary to either remove the old studs and reposition them to better correspond with the new positions of the female receiving snaps or simply skipping the fastener, i.e. not securing the cover at that particular location.

Various attempts to overcome these difficulties are known in the art. One such technique includes fastening the snap stud to a detachable clip and attaching that clip to the boat railing. This technique is disclosed in U.S. Pat. No. 2,961,725 to McGee wherein a metal or standard injection molded plastic clip is formed with a integral male snap stud member attached on one portion of the clip for use in cover attachment to the boat windshields.

A similar technique is disclosed in U.S. Pat. No. 3,367,349 to O'Link wherein a metal bracket is comprised of a flat web portion and an inwardly turned flange portion which is adapted to seat and travel along a groove contained within a boat rail. See also U.S. Pat. No. 4,292,913 to Siebert et al.

Many of the fastening devices existing in the prior art cooperate only with a boat railing or windshield railing that contain specially configured grooves that extend along the length of the railing. These grooves were generally included in the fastening system to facilitate a better gripping or fastening force between the boat clip device and the rail itself. The gripping force created by these prior art devices often necessitated providing a release latch or extending portion specifically for use in removing the boat clip from the boat railing.

SUMMARY OF THE INVENTION

The present invention contemplates a cover fastening device that may be utilized on either a boat rail having radial edges adjacent to the back side or conventional straight edges adjacent to the back side. The base wall member of the cover fastening device has a pair of resilient arms adapted to extend across the top and bottom sides of the boat railing toward the back side of the railing. The resilient arms are slightly angled in toward each other forming angles of about 3° between the resilient arms and the base wall member of the clip. The extension of the resilient arms across the top and bottom sides of the boat rail creates a gripping force between the fastening device and the boat rail sufficient to attach a covering or canopy.

At the distal ends of each gripping arm is a gripping hook configured to curve around the radial edges of the boat rail terminating short of the back side to prevent the gripping hooks from extending onto the back side. This configuration of the gripping hooks allows for attachment of the cover fastening device onto the boat rails without interference with the boat body or boat panel positioned directly behind the boat railing. This configuration also allows the cover fastening device to be slidable along the length of the boat rail to better mate with the respective female snap locks attached to the boat covering or canopy.

The invention further contemplates a boat cover fastening device that combines easy removal of the fastening device from the respective boat railing while creating a sufficient gripping force around the boat railing to fasten a boat cover across an open space of the boat. The gripping force is created without the use of special boat railing grooves that cooperate with extending members positioned on a fastening device. The present invention can be utilized on common elongated tubings with radial edges or straight edges that are commonly used in the industry today.

The present invention still further contemplates a boat cover fastening device that effectively fastens a boat cover to a boat railing and is also easily detachable from the boat railing with or without an extending release member. The unique design of the boat cover fastening device allows for easy detachment of the clip from the boat railing with a simple rotational movement of the clip. The gripping hook does not interfere with the boat panels, that are positioned directly behind the boat railing.

Further, the present invention provides a fastening device that can be slid in any desired direction and positioned anywhere along the length of the boat railing.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
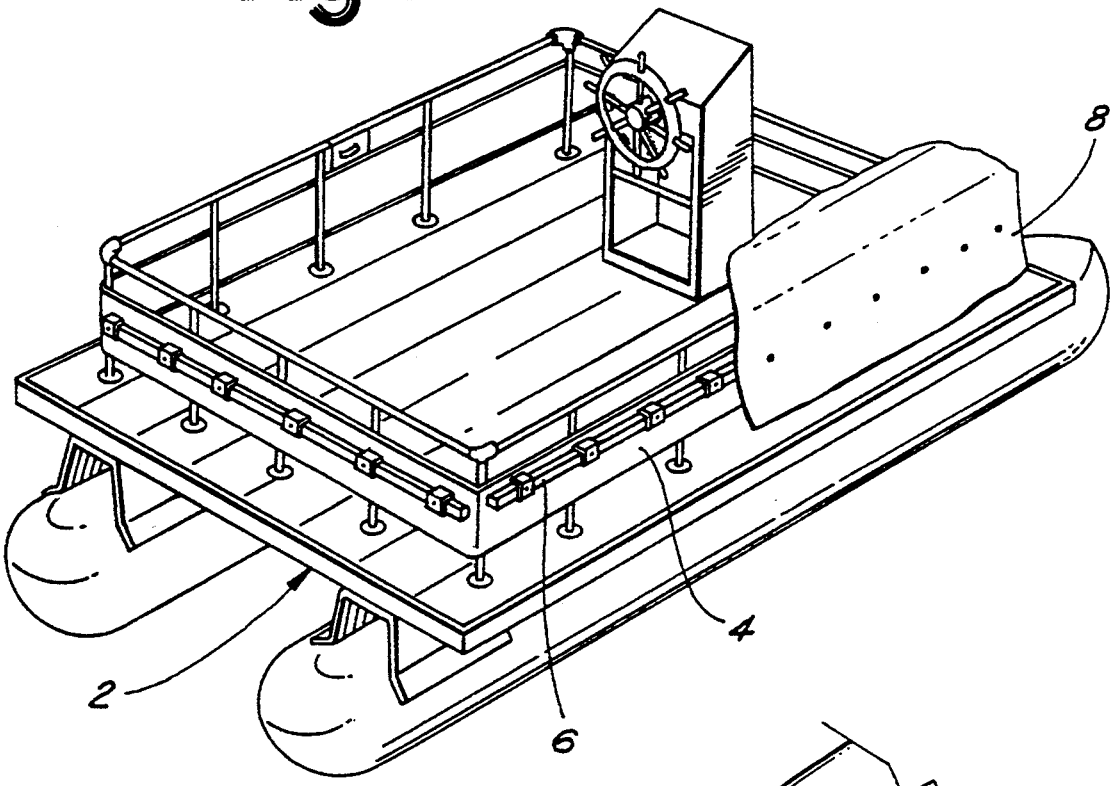
FIG. 1 is a perspective view of a boat having a railing upon which the fastening device of the present invention may be used.

FIG. 1 shows a conventional pontoon boat 2 with a boat panel 4 and boat railing 6 surrounding the outer perimeter of the platform of the pontoon boat. This illustrates the present invention being used to secure a boat cover 8 upon a boat railing 6. The boat cover 8 traverses the top and side portions of the boat framework. The lower portions of the boat cover are secured to the boat railing by a snap lock system contained on the boat cover and on the fastening device.

Figure 2:
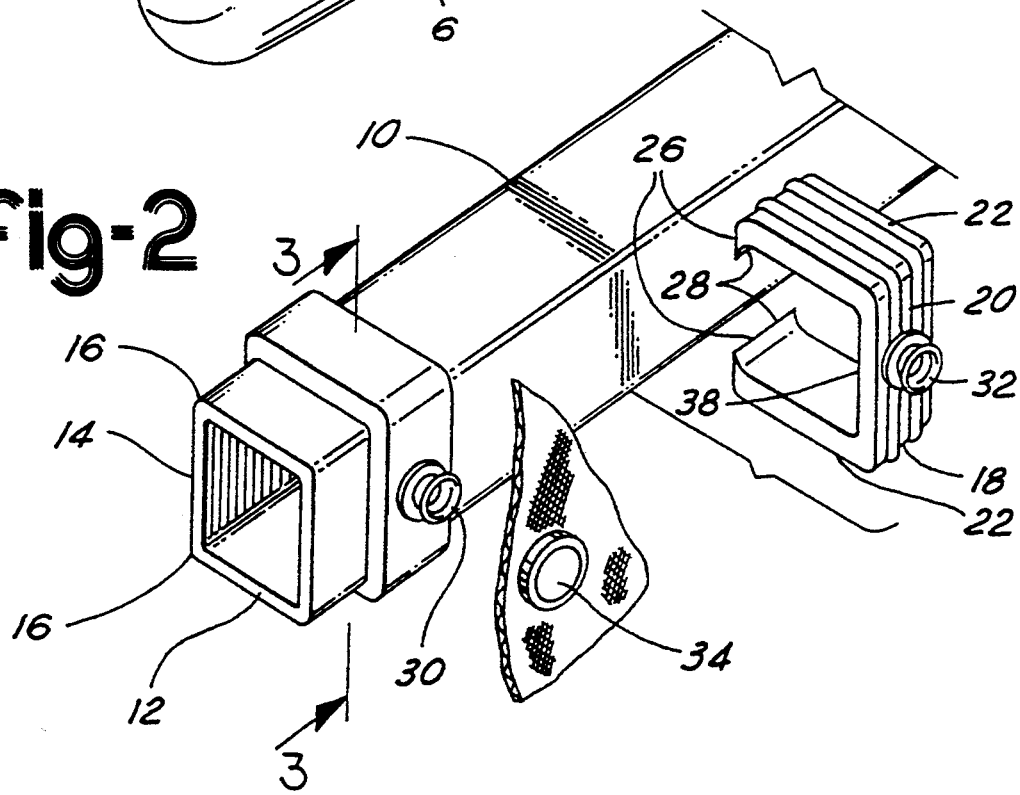
FIG. 2 is a fragmentary, perspective exploded view of the invention showing a boat railing, and a segment of the canvas boat cover with the female snap attached.
Figure 6:
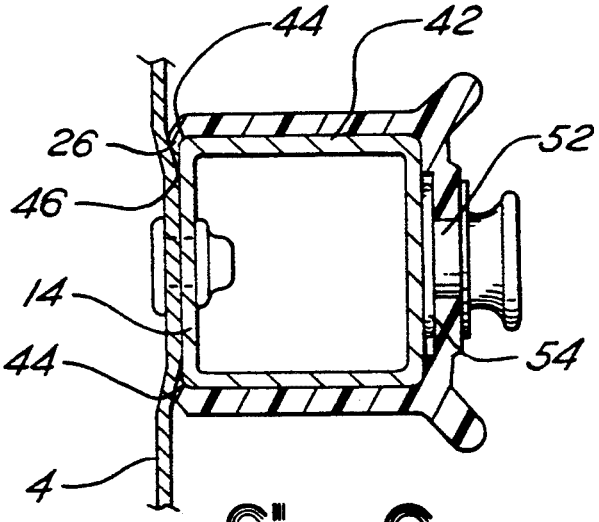
FIG. 6 is a fragmentary, partially sectioned view of one embodiment of the present invention, a boat panel and a boat railing.

FIG. 2 illustrates a boat railing in the form of an elongated tubing of generally rectangular cross-section. The boat railing has a top side 10, a bottom side 12 and a back side 14 with a pair of elongated radial edges 16 located at the joinder of the top and bottom sides with the back side. As shown in FIG. 6 and as will be discussed below, the present invention can be utilized on a boat railing having either elongated radial edges as shown in FIGS. 2 and 3 or substantially square edges as shown in FIG. 6.

Figure 3:
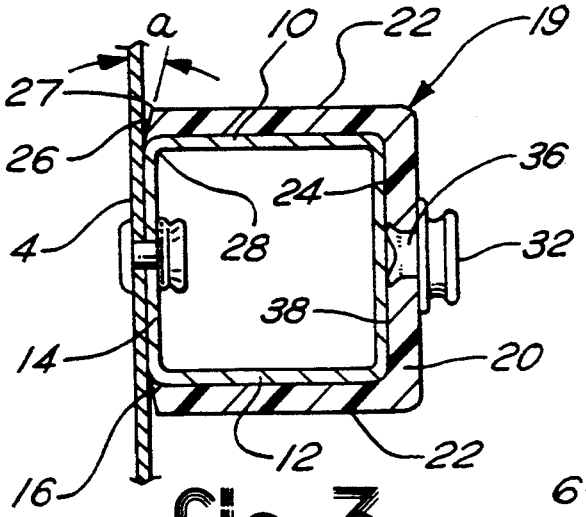
FIG. 3 is a fragmentary, partially sectioned view of one embodiment of the present invention taken along line 3—3 of FIG. 2.

Two different embodiments of the fastening device are illustrated in FIGS. 3 and 6. These embodiments differ structurally only in the inclusion of release members on the embodiment shown in FIG. 6 and are designed for use on both a boat railing having radial edges and a boat railing having substantially square edges. It is preferred that the fastening device be either injection molded or extrusion molded from a plastic material. Any relatively rigid but slightly resilient material that will allow the fastening device to snap-fit over the boat railing may be utilized to manufacture the fastening device.

The fastening device is designed to snap over the boat railing with sufficient tension to affix a boat cover over an open space. The boat cover can be in a relaxed state with only a few snaps connecting the cover to the railing with the inherent tension of clips holding the cover in place. When a cover is drawn tight over an open space with all snaps fastened, the tension of the cover holds the fastening device firmly in place against the top and bottom sides of the boat railing. When the cover is removed or folded down, the fastening device can be easily removed and stored for aesthetic reasons or left in place for future use.

FIGS. 2 and 3 show one embodiment of the present invention made from an injection molding of a plastic material. The fastening device 18 has a base wall member 20 and a pair of resilient arms 22 extending outward from one common side 24 of the base wall member. The resilient arms 22 extend substantially along the top 10 and bottom sides of the boat railing toward the back side 14 of the boat railing 6. The embodiment of the present invention shown in FIG. 2 uses a three degree angle between the resilient arms 22 and the base wall member. This three degree configuration of the resilient arms in relation to the base wall member increases the natural tendency of the resilient arms to bear on the top and bottom walls of the boat railing. This natural tension or gripping force tends to secure the fastening device to the boat railing.

An alternative embodiment of the present invention (not shown) contemplates using resilient arms configured in relation to the base wall member that are perpendicular to the base wall member. This configuration of the resilient arms operates in substantially the same manner as the prior embodiment containing the three degree angle but with a slightly reduced gripping force upon the boat railing.

Each of the resilient arms 22 of the present invention has a gripping hook 26 on the distal end which depends inwardly toward the opposing gripping hook. As shown clearly in FIG. 3, the gripping hooks are designed to curve around the radial edges 16 of the boat railing 6. Specifically, the length of the resilient arms 22 are equal to the length of the top and bottom sides of the boat railing. The gripping hooks 26 have an inner curved portion 28 which corresponds in shape and dimension to the radial edges 16 of the boat railing.

The unique design of the gripping hooks 26 allows the fastening device 18 to be affixed to a boat railing 6 without interfering with boat panels 4 commonly located behind the boat railing. The embodiment of the invention shown in FIG. 3 is attached to a boat railing having radial edges. Non-interference with the boat panels 4 is further enhanced by forming the front face 27 of each leg 22 at an acute angle a relative to the vertical axis of the boat panel 4 and back side 14 of the railing an inner face 60 is provided, as shown in FIG. 3, such that inner face 60 and front face 27 converge upon one another to provide a lip 62. Lip 62 projects forward of the respective resilient arms 22 or toward snap stud 32. If square edges are employed on the boat railing as in FIG. 6, a slight interference will occur between the gripping hooks and the boat panels located behind the boat railing.

The fastening device 18 has a fastener disposed within the base wall member. As shown in FIGS. 2 and 3, the preferred fastening system is a snap stud system comprised of a male snap stud 32 and a female receiving snap 34 as shown in FIG. 2. FIG. 3 shows stud with a post snap stud system which utilizes a conventional female receiving snap (not shown) with a post 36 that is affixed to the base wall member 20 without having any snap stud elements extending beyond the inner wall 38 of the base wall member. Snap stud 32 can also be molded in plastic with an injection molding process.

Figure 4:
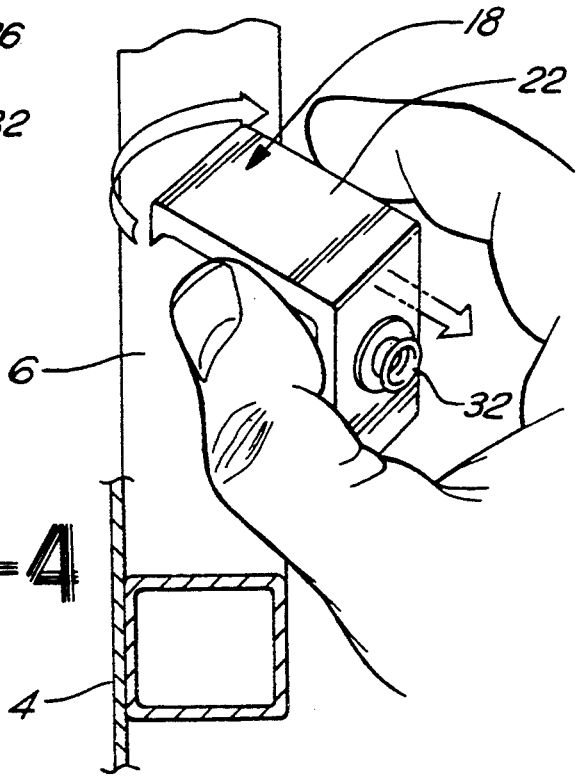
FIG. 4 is a perspective, partially sectioned view of one embodiment of the invention illustrating how the invention can be removed from the boat railing by rotating and pulling the fastening device simultaneously.

FIG. 4 shows a unique characteristic of the injection molded embodiment of the present invention shown in FIG. 3. The fastening device 18 may be easily removed from the boat railing 6 and still exert a gripping force sufficient on the boat railing 6 to secure and affix a cover or the like to the railing. Removal of the fastening device 18 is carried out by gripping the fastening device at the resilient arm portions 22 and exerting a twisting and pulling motion at the same time. This ease in removal allows for great flexibility in locating the fastening devices along the lengths of the boat railings covering the perimeter of the boat. In addition, the ability to slide the fastening device along the length of the railing adds to its flexibility.

Figure 5:
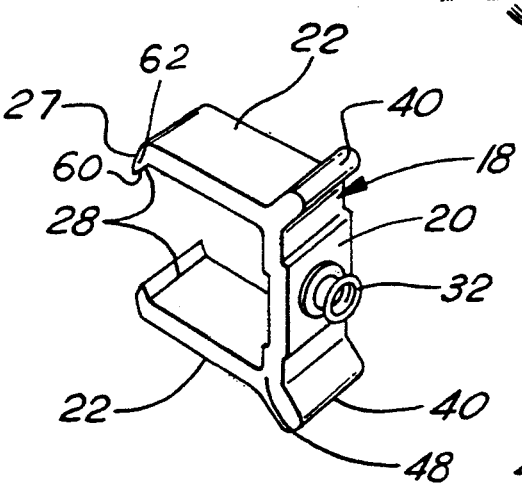
FIG. 5 is a perspective view of one embodiment of the invention illustrating extending release members.

FIG. 5 shows an alternative embodiment of the present invention having release members 40 extending outward from the juncture created by the base wall member 20 and the resilient arm portions 22. These extending release members facilitate an easy removal of the fastening device 18 from the boat railing but are not needed for effective utilization of the device. The formation of the extending members requires more plastic material to be deposited along the juncture created by the base wall member and the resilient arms. This thickened portion 48 provides reinforcement in the fastening device at a point where stress occurs when affixing and removing the device from the boat railing. The embodiment of the present invention shown in FIG. 5 is formed by cutting the fastening device to a limited length from an extended extruded section of substantially greater length.

As shown more clearly in FIG. 6, this alternative embodiment of the present invention can be readily affixed to a boat railing 42 having substantially square edges 44. In utilizing the present invention with a boat railing of this construction, the gripping hooks 26 traverse over and beyond the square edges 44 of the boat railing 42. The end portions 46 of the gripping hooks 26 thereby extend into the cavity created between the back side 14 of the boat railing and the boat panel 4 located behind the boat railing.

Specifically, the pointed configuration of the gripping hooks 26 and the resiliency of the material in which the gripping hooks are manufactured allows the gripping hooks to enter into this cavity with a minimal amount of interference to the boat panel. As with the prior embodiment, the lengths of the resilient arms should be approximately equal to the lengths of the top and bottom sides of the boat railing. It should be noted that the interference with the boat panel is minimal and does not restrict the movement of the fastening device along the boat rails. The fastening device can still be easily slid to any position along the length of the railing to mate with the female receiving snaps.

The embodiment shown in FIG. 6 also incorporates an alternative snap stud system. This "double stud" system uses a hollow snap stud 50 which accepts a second retaining stud 52 inside the hollow portion of the snap stud 50. The second retaining stud 52 includes a retaining member 54. When the second retaining stud 52 is inserted and affixed into the hollow snap stud 50, the retaining member 54 acts to support the snap stud within the fastening device 18.

While the above description constitutes the preferred embodiments of the present invention, it will be appreciated that the invention is susceptible to modification, variation and change without departing from the proper scope and fair meaning of the accompanying claims. Specifically, while the invention has been described as a fastener clip assembly for securing a boat cover, it applies equally to securing other types of flexible covers to a rigid framework, such as porch awnings and similar applications.

What is claimed is:

1. In combination, a railing formed from elongated tubing having at least a top side, a bottom side, a back side and a pair of edges adjacent said back side, and a fastening device, said fastening device comprising:

a base wall member, and a pair of resilient arms extending outwardly from one common side of said base wall member at an angle substantially perpendicular to said base wall member and extending substantially along said top and bottom sides of said railing toward said back side of said railing in a gripping relation to said railing;

each of said resilient arms having a gripping hook on the distal end thereof depending inwardly toward one another, each said hook curving around a respective one of said pair of railing edges toward each other; and a fastener attached to said base wall member affixing a cover or the like to said frame member.

2. In combination, a flexible boat cover, a boat railing formed from elongated tubing having at least a top side, a bottom side, a back side and a pair of radial edges adjacent said back side, and a plurality of fastening devices for securing said boat cover to said railing, said fastening device comprising:

a base wall member, and a pair of resilient arms extending outwardly from one common side of said base wall member at an angle substantially perpendicular to said base wall member and extending substantially along said top and bottom sides of said boat railing toward said back side of said railing in a gripping relation to said railing;

each of said resilient arms having a gripping hook on the distal end thereof depending inwardly toward one another, each said hook curving around the radial edges toward each other; and a fastener attached to said base wall member affixing a cover or the like to said frame member.

3. The combination as in claim 2 wherein said fastening device is made of plastic.

4. The combination as in claim 2 wherein said fastener is a snap stud.

5. The combination as in claim 2 wherein each of said resilient arms converge toward one another at said distal ends at an angle of about 3 degrees from said base wall member to thereby increase the gripping force of said arms on said frame member.

6. The combination of claim 5 wherein each said gripping hook includes a front face and an inner face converging upon one another to provide a lip at the end portion thereof;

said front face being inclined at an acute angle relative to said back side of said boat railing whereby said lip projects forward of the respective one of said resilient arms; and said inner face being curved in a manner substantially conforming to the shape of said radial edges of said boat railing.

* * * * *